US005707320A

United States Patent [19]

Yu

[11] Patent Number: 5,707,320

[45] Date of Patent: Jan. 13, 1998

[54] SWIMMING EXERCISER

[76] Inventor: Huei-Nan Yu, No. 14, Lane 252, Chien Kuo Road, Tao Yuen City, Taiwan

[21] Appl. No.: 768,439

[22] Filed: Dec. 18, 1996

[51] Int. Cl.[6] ..... A63B 69/14

[52] U.S. Cl. ..... 482/56; 482/51

[58] Field of Search ..... 482/55, 56, 51; 434/254

[56] References Cited

U.S. PATENT DOCUMENTS

| | | | |
|---|---|---|---|
| 2,013,520 | 9/1935 | McDermott | 482/56 |
| 5,158,513 | 10/1992 | Reeves | 482/56 |
| 5,336,426 | 8/1994 | Glavin | 482/56 |
| 5,429,563 | 7/1995 | Engel et al. | 482/51 |
| 5,496,235 | 3/1996 | Stevens | 482/51 |
| 5,536,224 | 7/1996 | Hsieh | 482/51 |
| 5,584,781 | 12/1996 | Chen | 482/51 |

*Primary Examiner*—Lynne A. Reichard

*Attorney, Agent, or Firm*—David E. Dougherty, Esq.

[57] ABSTRACT

Disclosed is a swimming exerciser mainly including a main frame, a pair of pedal means pivotally connected to two rear ends of the main frame, an height-adjustable abdomen cushion connected to a front top of the main frame, a front telescopic tubular support angularly and pivotally connected to and in front of the main frame, and a damping-type grip means mounted on a top of the telescopic tubular support. The grip means, the abdomen cushion and the pedal means together form an angle-adjustable inclined plane suitable for a user to train his or her body through imitative swimming movements.

1 Claim, 3 Drawing Sheets

SWIMMING EXERCISER

BACKGROUND OF THE INVENTION

There are many different kinds of exercisers, such as treading machine, jogging machine, chest expander, abdomen exerciser, etc., all are freely available on the market for consumers to select for use. However, it is desirable to have an exerciser which allows a user to train himself or herself through imitative swimming movements.

SUMMARY OF THE INVENTION

It is a primary object of the present invention to provide an exerciser for imitating swimming movements. The exerciser shall be referred to as "the swimming exerciser" through the entire specification hereinafter. The swimming exerciser provides a proper extent of damping so that a user may use the swimming exerciser to practice the way of skillful swimming and to train the body at the same time.

Another object of the present invention is to provide a swimming exerciser in which two grips, an abdomen cushion, and two pedals are provided for the user and all are angularly adjustable to enable the whole swimming exerciser to be operated in a changeful and more effective manner.

To achieve the above and other objects, the swimming exerciser according to the present invention includes a main frame, a pair of pedal means pivotally connected to a rear end of the main frame, a height-adjustable abdomen cushion connected to a front end of the main frame, a forward inclined front telescopic tubular support angularly and pivotally connected to and in front of the main frame, and height-adjustable grip means mounted on a top end of the front telescopic tubular support. The grip means, the abdomen cushion and the pedal means together form an angle-adjustable inclined plane suitable for a user to effectively train his or her body through imitating swimming movements.

DETAILED DESCRIPTION OF THE PREFERRED EMBODIMENT

Figure 1:
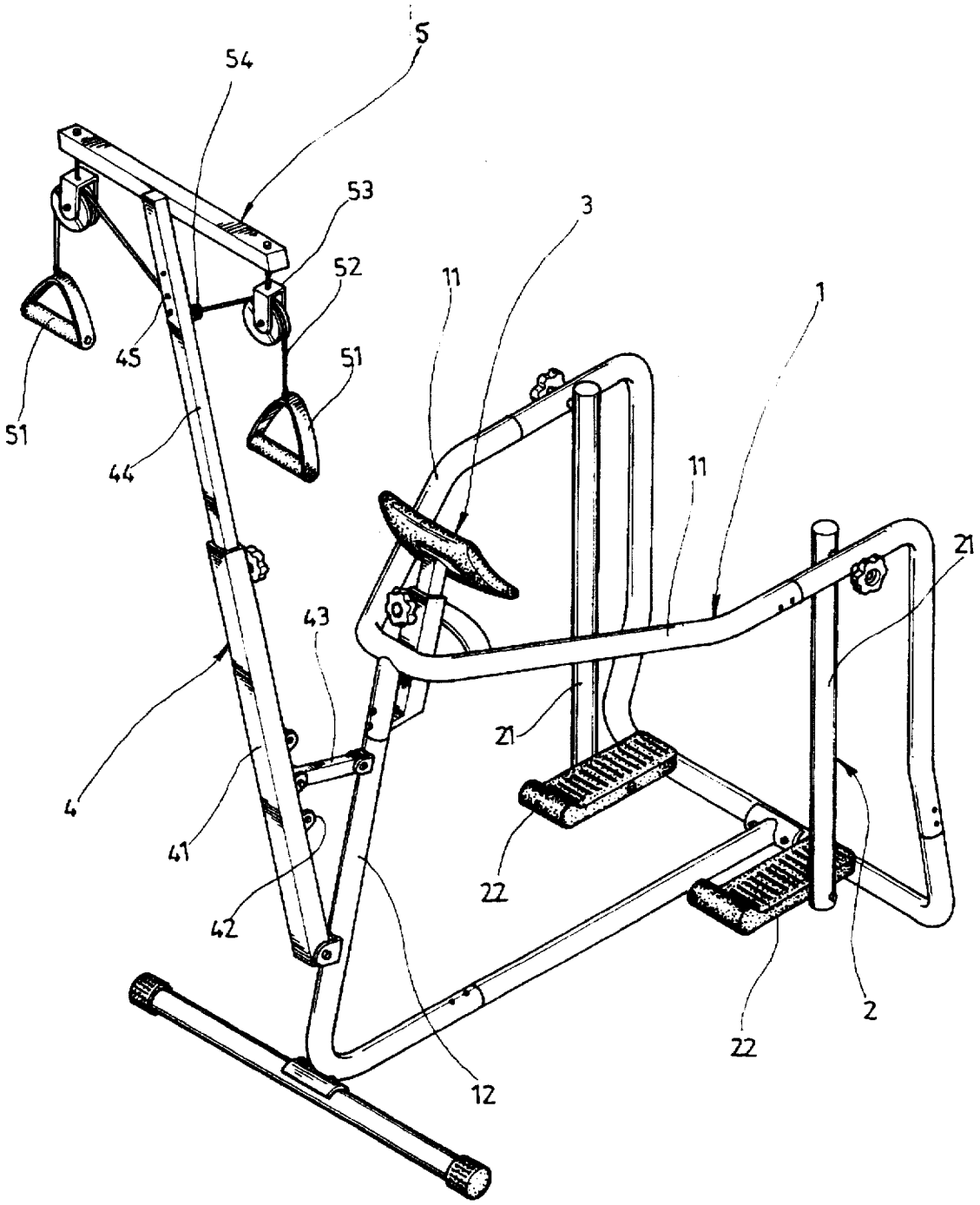
FIG. 1 is a three-dimensional perspective of a swimming exerciser according to the present invention.

Please refer to FIG. 1. The present invention relates to an exerciser for imitating swimming movements and shall be referred to as a "swimming exerciser" hereinafter. The swimming exerciser of the present invention mainly includes a main frame 1, a pair of pedal means 2, an abdomen cushion 3, a front telescopic tubular support 4, and a grip means 5.

The main frame 1 includes a left and a right substantially horizontally extended protective rails 11 and a slightly angularly upward extended front middle stem 12.

The pair of pedal means 2 each includes a substantially vertically extended link 21 pivotally connected at an upper end to a rear inner side of one of the protective rails 11, and a pedal 22 pivotally connected to a lower end of the link 21.

The abdomen cushion 3 is connected to a front joint of the left and the right protective rails 11. A distance between the abdomen cushion 3 and the joint of the rails 11 is adjustable.

The front telescopic tubular support 4 is pivotally connected at a lower end to a front lower portion of the front middle stem 12 of the main frame 1 and further includes an outer section 41 and an inner section 44 slidable up and down within the outer section 41. A plurality of connecting holes 42 are formed near a lower end of the outer section 41 for selectively receiving an end of an adjusting stem 43 which is pivotally connected at the other end to the front middle stem 12, thereby the front telescopic tubular support 4 can be adjusted in its angular position relative to the front middle stem 12 by connecting the adjusting stem 43 to a different connecting hole 42 each time, so as to meet the need of a user operating the swimming exerciser. The inner section 44 can be slidably moved up and down within the outer section 41 to adjust its height.

The grip means 5 further includes a pair of hand grips 51, an elastic strap 52, and a pair of pulleys 53. The pair of pulleys 53 are mounted to a top portion of the inner section 44 of the front telescopic tubular support 4 to each locate at one side of the inner section 44. The elastic strap 52 is locked at a middle point to a retaining means 54 provided on the inner section 44 with two ends passing through the pair of pulleys 53 to each connect one of the two hand grips 51. A plurality of adjusting holes 45 are formed on the inner section 44 to selectively receive the retaining means 54 therein, so that the elastic strap 52 can be adjusted in length to provide different magnitude of damping, forming a hand grip means having damping effect to train two arms of the user practicing swimming.

Figure 2:
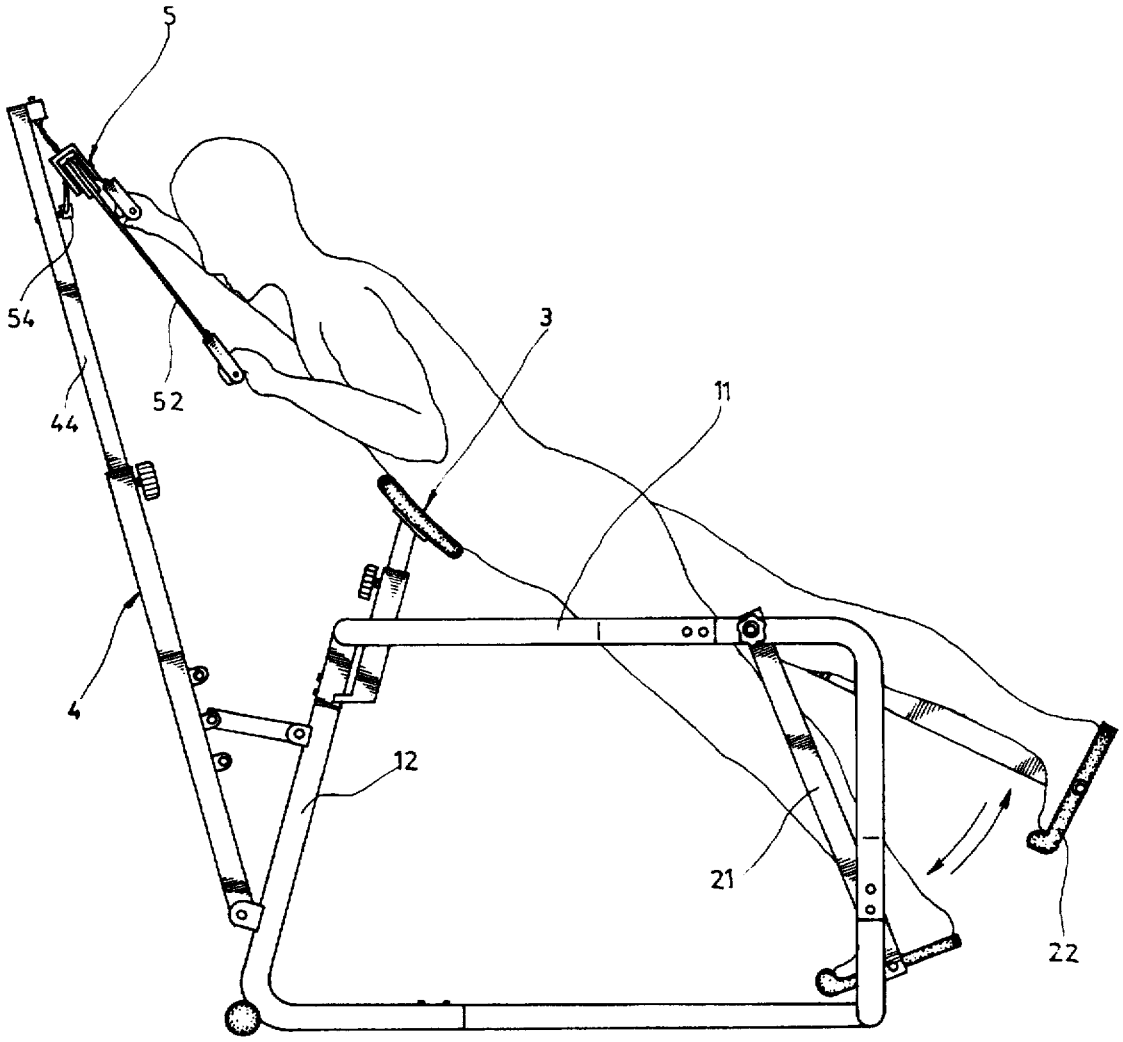
FIG. 2 is a side view of the swimming exerciser of the present invention in use.

With the angularly adjustable arrangements for the hand grip means 5, the abdomen cushion 3 and the pair of pedal means 2, the swimming exerciser of the present invention can be operated in changeful manners for the user to effectively imitate different swimming movements, as shown in FIG. 2.

Figure 3:
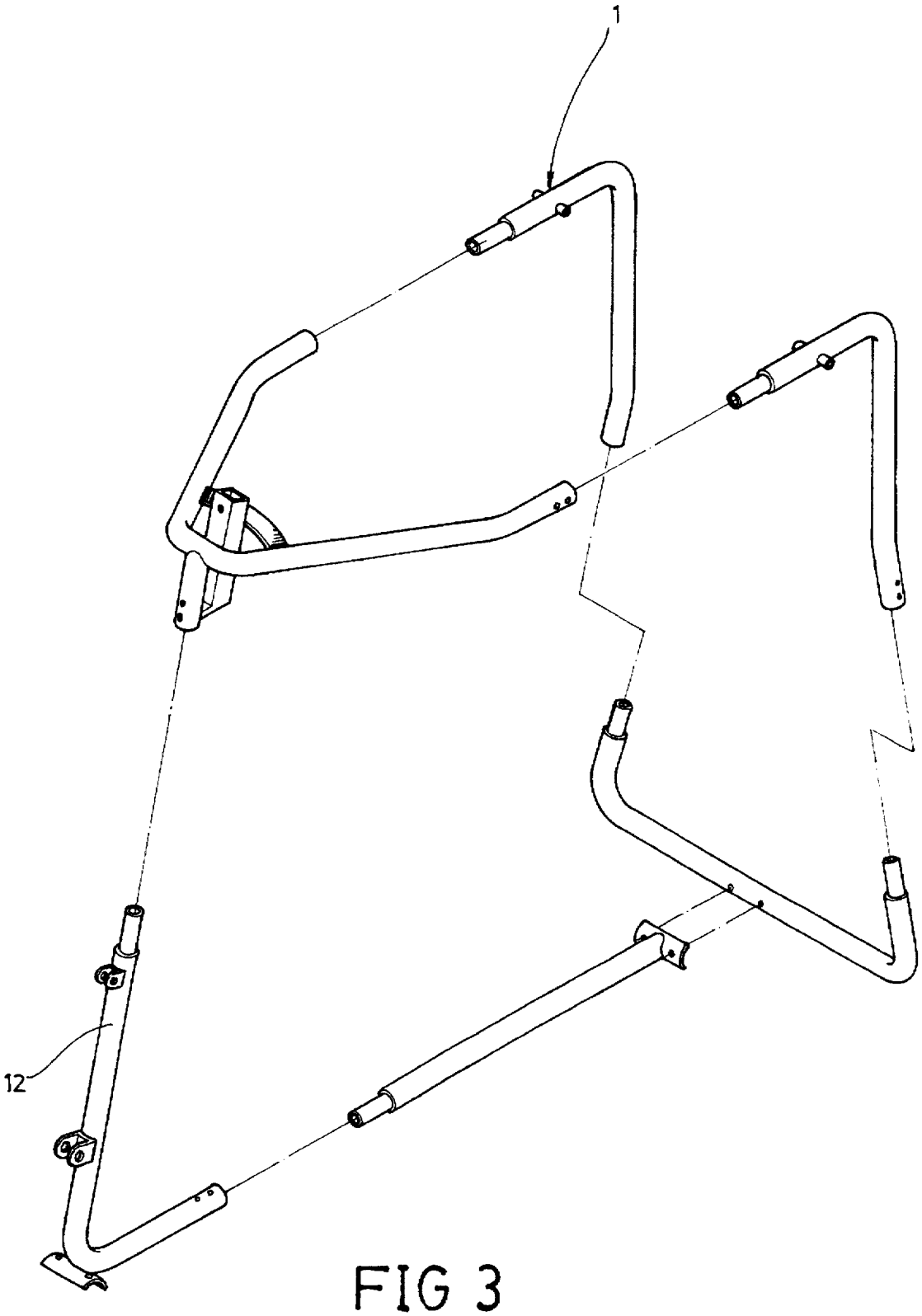
FIG. 3 illustrates the manner in which the main frame of the swimming exerciser is assembled from different sections.

Furthermore, the present invention can be designed as a knockdown type and be assembled from many detachably connected sections, as shown in FIG. 3. When the swimming exerciser of the present invention is not in use, it can be disassembled to minimize the space required for storage and transportation and therefore meets the economical requirement and the design tendency of many different exercisers.

What is claimed is:

1. A swimming exerciser for users to train their body through imitative swimming movements, comprising a main frame, a pair of pedal means, an abdomen cushion, a front telescopic tubular support, and a grip means;

said main frame including two lateral substantially horizontally extended protective rails and a slightly angularly upward extended front middle stem;

said pair of pedal means each including a substantially vertically extended link pivotally connected at an upper end to a rear inner side of one of said protective rails of said main frame, and a pedal pivotally connected to a lower end of said link;

said abdomen cushion being connected to a front joint of said two protective rails with an adjustable distance left between said abdomen cushion and said protective rails;

said front telescopic tubular support being pivotally and angularly connected at a lower end to a front lower portion of said front middle stem of said main frame and further including an outer section and an inner section slidable up and down within said outer section; and said grip means being mounted to a top end of said front telescopic tubular support and including a pair of pulleys located at two sides of said front telescopic tubular support, an elastic strap being locked at a middle point to a height-adjustable retaining means on said inner section of said telescopic tubular support with two ends passing through said pair of pulleys, and a pair of hand grips connected to two ends of said elastic strap;

whereby said grip means, said abdomen cushion and said pedal means together form an angle-adjustable inclined plane on said swimming exerciser for best training a user through imitative swimming movements.

* * * * *